US012560332B2

(12) United States Patent
Zhang et al.

(10) Patent No.: US 12,560,332 B2
(45) Date of Patent: Feb. 24, 2026

(54) FLAMEOUT PROTECTION SYSTEM AND HEATER

(71) Applicant: SHINERICH INDUSTRIAL LTD., Shenzhen (CN)

(72) Inventors: Guangrong Zhang, Shenzhen (CN); Cuilong Li, Shenzhen (CN)

(73) Assignee: SHINERICH INDUSTRIAL LTD., Shenzhen (CN)

( * ) Notice: Subject to any disclaimer, the term of this patent is extended or adjusted under 35 U.S.C. 154(b) by 383 days.

(21) Appl. No.: 18/300,151

(22) Filed: Apr. 13, 2023

(65) Prior Publication Data

US 2024/0219034 A1 Jul. 4, 2024

Related U.S. Application Data

(63) Continuation of application No. PCT/CN2023/083951, filed on Mar. 27, 2023.

(30) Foreign Application Priority Data

Dec. 30, 2022 (CN) ..... 202223613194.1

(51) Int. Cl.
*F24D 19/10* (2006.01)
*F23N 5/24* (2006.01)
(Continued)

(52) U.S. Cl.
CPC ..... *F24C 3/122* (2013.01); *F23N 5/242* (2013.01); *F24C 3/042* (2013.01); *F23N 2229/12* (2020.01)

(58) Field of Classification Search
CPC .. F24C 3/122; F24C 3/042; F24C 1/12; F23N 5/242; F23N 5/123; F23N 2229/12; F24D 15/02; F24D 19/10
See application file for complete search history.

(56) References Cited

U.S. PATENT DOCUMENTS 4,622,005 A 11/1986 Kuroda
5,961,311 A 10/1999 Moore, Jr.
(Continued)

FOREIGN PATENT DOCUMENTS

CN 2200768 Y * 6/1995
CN 2563459 Y 7/2003
(Continued)

OTHER PUBLICATIONS

International Search Report and Written Opinion issued in corresponding PCT Application No. PCT/CN2023/083951, dated Aug. 14, 2023.
(Continued)

*Primary Examiner* — Gregory A Wilson
(74) *Attorney, Agent, or Firm* — Westbridge IP LLC

(57) ABSTRACT

Disclosed are a flameout protection system and a heater. The flameout protection system includes a stove head, a double-needle electrode rod, an electromagnetic valve and a plasma controller. The stove head is provided with an ejection tube and a flame hole. The double-needle electrode rod is connected to the ejection tube, and one end of the double-needle electrode rod is close to the flame hole. The electromagnetic valve is connected to the ejection tube, and the electromagnetic valve is communicated with the flame hole. The plasma controller is electrically connected to the double-needle electrode rod, and the plasma controller is electrically connected to the electromagnetic valve.

8 Claims, 7 Drawing Sheets

(51) Int. Cl.
*F24C 3/04* (2021.01)
*F24C 3/12* (2006.01)

(56) References Cited

U.S. PATENT DOCUMENTS

| | | | | |
|---|---|---|---|---|
| 6,102,031 | A | 8/2000 | Waters | |
| 6,322,352 | B1 * | 11/2001 | Zink | F23N 5/123 431/82 |
| 11,692,707 | B2 * | 7/2023 | Pablo Curto | F23Q 3/008 431/264 |
| 2008/0163866 | A1 | 7/2008 | Jin | |

FOREIGN PATENT DOCUMENTS

| | | | | | |
|---|---|---|---|---|---|
| CN | 2605497 | Y | | 3/2004 | |
| CN | 2888296 | Y | | 4/2007 | |
| CN | 101118064 | A | | 2/2008 | |
| CN | 101586818 | A | | 11/2009 | |
| CN | 201672595 | U | | 12/2010 | |
| CN | 201706553 | U | * | 1/2011 | |
| CN | 202675386 | U | | 1/2013 | |
| CN | 206430105 | U | * | 8/2017 | |
| CN | 109386849 | A | | 2/2019 | |
| CN | 109882884 | A | * | 6/2019 | F23N 5/003 |
| CN | 111828705 | A | * | 10/2020 | F17D 3/01 |
| CN | 112178699 | A | * | 1/2021 | F24C 3/085 |
| CN | 214891350 | U | | 11/2021 | |
| JP | S51147083 | U | | 11/1976 | |
| JP | S5325937 | A | | 3/1978 | |
| JP | 2002295829 | A | * | 10/2002 | |
| KR | 940003062 | Y1 | * | 5/1994 | F24C 3/002 |

OTHER PUBLICATIONS

Extended European Search Report issued in counterpart European Patent Application No. 23711926.8, dated Nov. 20, 2024.

* cited by examiner

FLAMEOUT PROTECTION SYSTEM AND HEATER

CROSS-REFERENCE TO RELATED APPLICATIONS

This application is a continuation application of International Application No. PCT/CN2023/083951, filed on Mar. 27, 2023, which claims priority to Chinese Patent Application No. 202223613194.1, filed on Dec. 30, 2022. The disclosures of the above-mentioned applications are incorporated herein by reference in their entireties.

TECHNICAL FIELD

The present disclosure relates to the technical field of heating devices, in particular to a flameout protection system and a heater.

BACKGROUND

The heater is a heating device with an umbrella-like shape. The heater is provided outdoors, which uses gas combustion technique to supply heat. A stove head is provided inside the heater, the liquefied gas is ignited by the stove head to generate a flame, and the temperature around the umbrella heater is improved by radiating heat from the flame.

The heater is designed with a flameout protection system to prevent the heater from continuously supplying liquefied gas to the stove head when the stove head is turned off due to failure or other reasons, resulting in serious safety hazards caused by liquefied gas leakage. The existing flameout protection system is usually a thermocouple flameout protection system, which determines whether there is an open flame by identifying the temperature of the stove head through the thermocouple. However, the thermocouple has a short service life due to long-term exposure to open flames. Besides, the thermocouple temperature response is slow, some liquefied gas will still leak.

SUMMARY

The main objective of the present disclosure is to provide a flameout protection system. aiming to solve the problem that the efficiency of the flameout protection system of the existing heater is low.

To realize the above objective, the present disclosure provides a flameout protection system, including: a stove head, a double-needle electrode rod, an electromagnetic valve and a plasma controller.

The stove head is provided with a flame hole and an air intake communicated with the flame hole.

The double-needle electrode rod is connected to the stove head.

The electromagnetic valve is provided at the air intake and configured for controlling an on-off of the air intake.

The plasma controller is electrically connected to the double-needle electrode rod and the electromagnetic valve.

One end of the double-needle electrode rod is close to the flame hole, and the plasma controller is configured for controlling the electromagnetic valve to open or close the air intake.

In an embodiment, the stove head includes a burner, an ejection tube, and a burner bracket.

The burner is provided with the flame hole.

The ejection tube is connected to the burner.

The burner bracket is connected to the ejection tube.

The ejection tube is provided with the air intake, and the electromagnetic valve is connected to the ejection tube, and the double-needle electrode rod is connected to the burner bracket.

In an embodiment, a periphery of the burner is provided with a plurality of flame holes, and the plurality of the flame holes are evenly spaced apart along the periphery of the burner.

In an embodiment, the flameout protection system includes two double-needle electrode rods, and the two double-needle electrode rods are located at opposite sides of the stove head.

In an embodiment, each of the two double-needle electrode rods includes a high-voltage probe and a low-voltage probe, the high-voltage probe and the low-voltage probe are provided at intervals, the low-voltage probe is adjacent to the stove head, and the high-voltage probe is away from the stove head.

In an embodiment, a resistance value of the electromagnetic valve is 750 ohms.

The present disclosure further provides a heater, including: a protective cover, and any one of the above-mentioned flameout protection system.

The protective cover is provided with an installation cavity.

The flameout protection system is provided in the installation cavity.

In an embodiment, the protective cover includes a casing, an infrared cover, and a reflection cover.

The infrared cover is connected to the casing.

The reflection cover is connected to the infrared cover, the infrared cover is provided with corrugated ribs.

The casing, the infrared cover and the reflection cover form the installation cavity, and the flameout protection system is provided in the installation cavity.

In an embodiment, the casing is provided with a maintenance door and a knob, the installation cavity is opened or closed by the maintenance door, and the knob is configured for controlling the electromagnetic valve, and or the heater further includes a decorative light, the decorative light is provided on the casing or the knob, and the decorative light is electrically connected to the flameout protection system.

In an embodiment, the heater further includes a base, and a sand cover.

The base is connected to the protective cover.

The base is provided with a counterweight cavity and a sand filling hole, the sand filling hole is communicated with the counterweight cavity, and the sand cover is detachably connected to the sand filling hole; and/or the heater further includes a high-pressure relief valve, one end of the high-pressure relief valve is connected to the flameout protection system, and another end of the high-pressure relief valve is connected to a liquefied gas source.

The technical solution of the present disclosure provides a flameout protection system including a stove head, a double-needle electrode rod, an electromagnetic valve and a plasma controller. The stove head is disc-shaped, an outer periphery of the stove head is provided with a flame hole and an air intake, and the flame hole are communicated with the air intake. The double-needle electrode rod is fixed on the stove head, one end of the double-needle electrode rod is close to the flame hole, and another end of the double-needle electrode rod is electrically connected to the plasma controller. The electromagnetic valve is fixed on the air intake, and the plasma controller is electrically connected to the electromagnetic valve for controlling the electromagnetic valve to open or close. When the heater is ignited, the plasma controller controls the electromagnetic valve to open, so that the liquefied gas can flow into the burner, release from the flame hole after mixed with air, and mix with air for the second time outside the burner. The double-needle electrode rod is then controlled by the plasma controller to generate a high-voltage electric spark, which lasts for 3 to 5 seconds to ignite the mixture of liquefied gas and air, so that the burner continues to burn the liquefied gas to generate heat and radiate the surrounding environment. Then one end of the double-needle electrode rod is covered by the flame. The plasma controller sends out electrical signals according to a certain frequency, and the flame makes the two probes of the double-needle electrode rod conducted, so that the double-needle electrode rod can feed back the electrical signal to the plasma controller. The plasma controller determines that the flame is continuing according to the electrical signal, and keeps the electromagnetic valve open. When the flame of the burner is extinguished due to the environment or its own failure, the double-needle electrode rod cannot feedback the electrical signal, and the plasma controller that cannot receive the electrical signal controls the electromagnetic valve to close to prevent the continuous leakage of liquefied gas and thus cause safety hazards. The time interval for the double-needle electrode rod to generate electric sparks to ignite the liquefied gas and the time interval for identifying the flame to generate electrical signals are divided by the plasma controller and software, so that only one double-needle electrode rod can realize the function of ignition and flameout protection simultaneously. In this way, the double-needle electrode rod recognizes the flame and feeds back to the plasma controller quickly, so that the plasma controller can respond in time and control the electromagnetic valve to close, reducing the leakage of liquefied gas. At the same time, the structure of the double-needle electrode rod is not complicated and is not easy to be damaged, which improves the service life and stability of the flameout protection system.

BRIEF DESCRIPTION OF THE DRAWINGS

In order to more clearly illustrate the technical solutions in the embodiments of the present disclosure or in the related art, drawings used in the embodiments or in the related art will be briefly described below. Obviously, the drawings in the following description are only some embodiments of the present disclosure. It will be apparent to those skilled in the art that other figures can be obtained according to the structures shown in the drawings without creative work.

Figure 1:
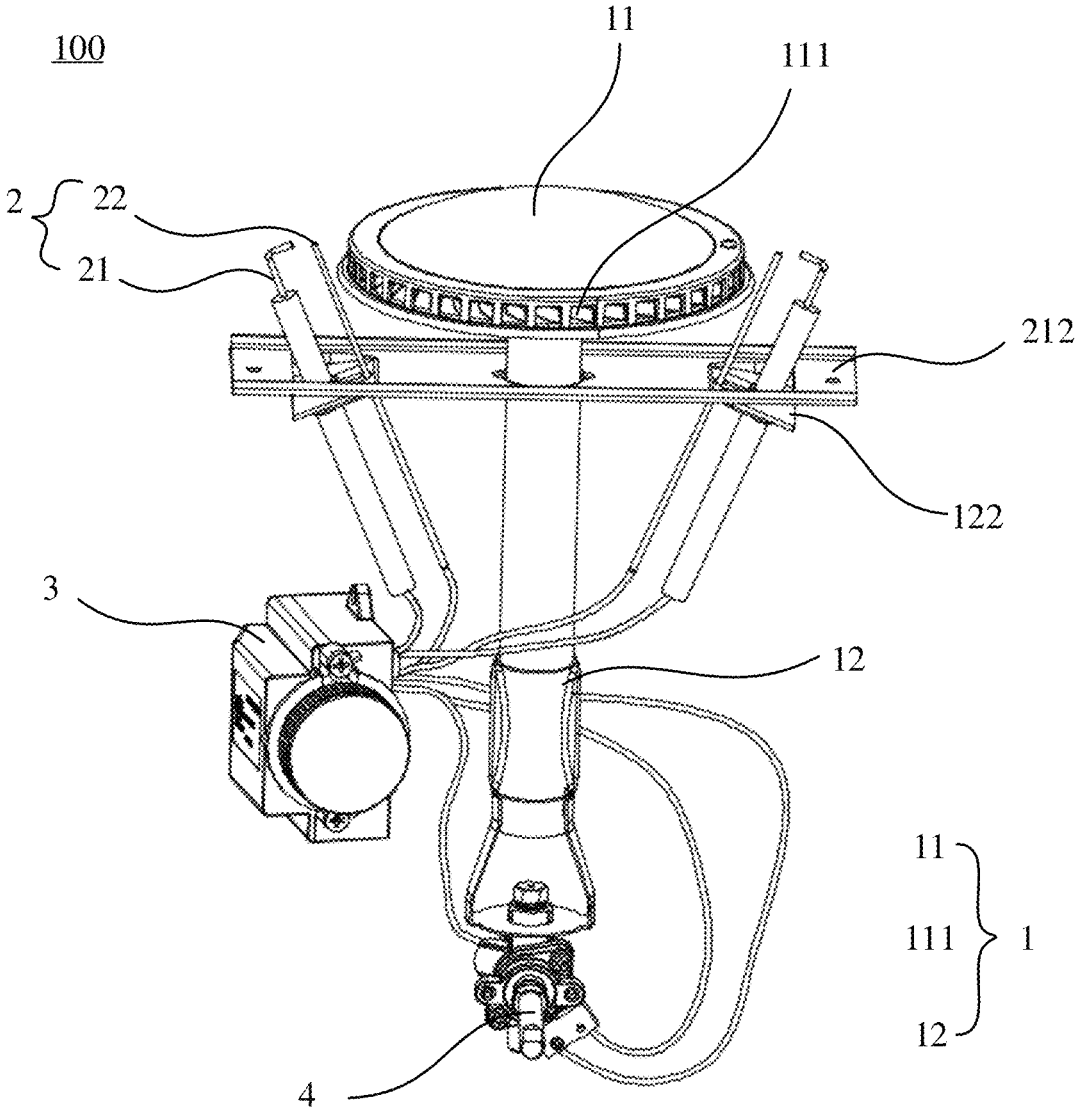
FIG. 1 is a schematic structural view of a flameout protection system according to an embodiment of the present disclosure.

The realization of the objective, functional characteristics, and advantages of the present disclosure are further described with reference to the accompanying drawings.

DETAILED DESCRIPTION OF THE EMBODIMENTS

The technical solutions in the embodiments of the present disclosure will be clearly and completely described below with reference to the drawings in the embodiment of the present disclosure. Obviously, the described embodiments are only a part of the embodiments of the present disclosure, not all of the embodiments. Based on the embodiments in the present disclosure, all other embodiments perceived by those ordinary skills in the art without creative effort should be fallen within the protection scope of the present disclosure.

It should be noted that all of the directional instructions in the embodiments of the present disclosure (such as, up, down, left, right, front, rear . . . ) are only used to explain the relative position relationship and movement of each component under a specific attitude (as shown in the drawings), if the specific attitude changes, the directional instructions will change correspondingly.

Besides, the descriptions in the present disclosure that refer to "first," "second," etc. are only for descriptive purposes and are not to be interpreted as indicating or implying relative importance or to implicitly indicate the number of technical features indicated. Thus, a feature defined as "first" or "second" may explicitly or implicitly include at least one of the features. In addition, technical solutions between the embodiments can be combined with each other, but must be based on the realization of the technical solutions by those skilled in the art, and when the technical solutions are contradictory to each other or cannot be realized, the technical solutions should be considered that the combination does not exist, and the technical solutions are not fallen within the protection scope claimed in the present disclosure.

As shown in FIG. 1, in an embodiment of the present disclosure, the flameout protection system 100 includes a stove head 1, a double-needle electrode rod 2, an electromagnetic valve 4 and a plasma controller 3. The stove head 1 is provided with a flame hole 111 and an air intake, and the air intake is communicated with the flame hole 111. The double-needle electrode rod 2 is connected to the stove head 1, and one end of the double-needle electrode rod 2 is close to the flame hole 111. The electromagnetic valve 4 is provided at the air intake and is configured for controlling an on-off of the air intake. The plasma controller 3 is electrically connected to the double-needle electrode rod 2 and the electromagnetic valve 4, and the plasma controller 3 is configured for controlling the electromagnetic valve 4 to open or close the air intake.

In an embodiment, the stove head 1 is of a disc-shaped structure, a flame hole 111 is provided on the periphery of the disc, and an ejection tube 12 is provided at the center of the bottom of the disc. One end of the ejection tube 12 is connected to the disc as a support, and another end of the ejection tube 12 is connected to the electromagnetic valve 4. The flame port and the electromagnetic valve 4 are communicated by a cavity provided inside the stove head 1, and the electromagnetic valve 4 is used as a switch to control the liquefied gas to flow into the cavity and flow out from the flame hole 111.

In an embodiment, the double-needle electrode rod 2 is composed of two probes, the two probes are juxtaposed and electrically connected to the plasma controller 3, and the two probes are provided at intervals. One end of the double-needle electrode rod 2 is located at one side of the flame hole 111. It is understood that air is not a good conductor, and flame, which usually exists in a plasma state, is a good conductor. When the flame burns the double-needle electrode rod 2 and continuously exits in a gap between the two probes, the flame can be used as a conductor to conduct the two probes, the plasma controller 3 sends an electrical signal to one of the probes, the electrical signal may be passed to another probe through the flame, and returns to the plasma controller 3 so that the plasma controller 3 can detect the electrical signal. If the flame is extinguished, two probes are disconnected, an electrical signal is sent to one of the probes and cannot return to the plasma controller 3 from another probe.

In the embodiment, when the heater is ignited, the plasma controller 3 controls the electromagnetic valve 4 to open, so that the liquefied gas can flow into the stove head 1 and be mixed with air, and then is released from the flame hole 111, then is mixed with air for a second time outside the stove head 1. The plasma controller 3 then controls the double-needle electrode rod 2 to generate a high-voltage electric spark, which lasts for 3 to 5 seconds to ignite the mixture of the liquefied gas and air, so that the stove head 1 continues to burn the liquefied gas to generate heat and radiate the surrounding environment. At this moment, one end of the double-needle electrode rod 2 is covered by the flame. The plasma controller 3 sends out electrical signals according to a certain frequency, and the two probes of the double-needle electrode rod 2 is conducted by the flame, so that the double-needle electrode rod 2 can feed back the electrical signal to the plasma controller 3. The flame is determined to be continued based on the electric signal by the plasma controller 3, so that the electromagnetic valve 4 is kept open. When the flame of the stove head 1 is extinguished due to the environment or its own fault, the double-needle electrode rod 2 cannot feedback the electrical signal, and the plasma controller 3 without receiving the electrical signal controls the electromagnetic valve 4 to close to prevent continuous leakage of liquefied gas and cause a potential risk. The plasma controller 3 and a software are used to determine a time interval for the double-needle electrode rod 2 to generate electric sparks to ignite the liquefied gas and a time interval for identifying the flame to generate electrical signals, so that only one double-needle electrode rod 2 is needed to realize the ignition and the flameout protection simultaneously. In this way, a process of the double-needle electrode rod 2 for identifying the flame and feeding back to the plasma controller 3 is quick, so that the plasma controller 3 can reflect the flameout in time and control the electromagnetic valve 4 to close, reducing the leakage of liquefied gas. At the same time, the structure of the double-needle electrode rod 2 is not complicated and not easy to be damaged, which improves the service life and stability of the flameout protection system 100.

As shown in FIG. 1, in an embodiment of the present disclosure, the stove head 1 includes a burner 11, an ejection tube 12 and a burner bracket 212. The burner 11 is provided with a flame hole 111. The ejection tube 12 is connected to the burner 11, and the ejection tube 12 is provided with the air intake, and the electromagnetic valve 4 is connected to the ejection tube 12. The burner bracket 212 is connected to the ejection tube 12, and the double-needle electrode rod 2 is connected to the burner bracket 212.

In an embodiment, the burner 11 is of a disc structure, and the burner 11 has a circumferential surface provided with the flame hole 111. Furthermore, a plurality of flame holes 111 are evenly provided around the circumferential surface, and the height, size and shape of the plurality of flame holes 111 are uniform. The burner 11 is provided with a gas cavity, and the flame holes 111 are communicated with the gas cavity, and the plurality of flame holes 111 are provided around the gas cavity. An ejection tube 12 is provided at the center of the bottom of the burner 11. One end of the ejection tube 12 is connected to a disc as a support, a gas cavity is provided in the burner 11, and is communicated with the flame hole 111, another end of the ejection tube 12 is provided with an air intake, and is communicated with the gas cavity. The ejection tube 12 is detachably connected with a burner bracket 212, the burner bracket 212 may rise or fall along a direction of the ejection tube 12, the burner bracket 212 is provided with an adjustment plate 122 that can adjust an angle, and the double-needle electrode rod 2 is detachably connected on the adjustment plate 122.

In the embodiment, the electromagnetic valve 4 is installed at the air intake of the ejection tube 12 for opening or closing the air intake. The double-needle electrode rod 2 is installed on the burner bracket 212, and the burner bracket 212 can be adjusted to adjust the position of the double-needle electrode rod 2.

Figure 2:
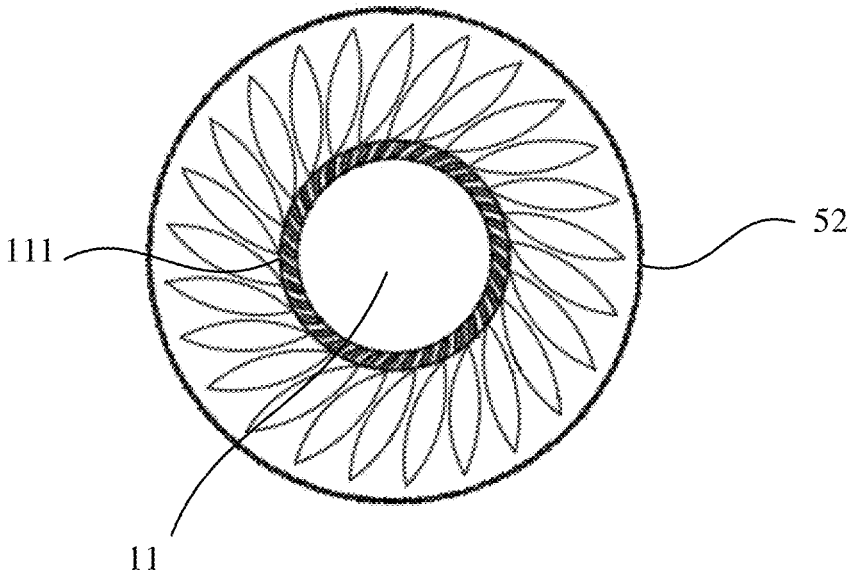
FIG. 2 is a schematic structural view of a flame shape of the flameout protection system according to an embodiment of the present disclosure.

As shown in FIG. 1 and FIG. 2, in an embodiment of the present disclosure, a periphery of the burner 11 is provided with a plurality of flame holes 111, and the plurality of flame holes 111 are evenly spaced apart along the periphery of the burner 11.

In an embodiment, the structure of the burner 11 is disc-shaped, and the flame holes 111 are provided on the outer edge of the circumference of the disc, and a plurality of flame holes 111 are evenly spaced apart around the burner 11.

Furthermore, being not perpendicular to the outer edge of the burner 11, the flame hole 111 is provided at an angle with the outer edge of the burner 11 instead, so that the flame hole 111 is obliquely provided on the burner 11, so that the flame is ejected along a direction of the flame hole 111 and is inclined to the burner 11, the flame ejected from the plurality of flame holes 111 are generally in the shape of a swirl.

In the embodiment, the plurality of flame holes 111 are provided obliquely around the burner 11, so that the flame ejected from the plurality of flame holes 111 are generally in the shape of the swirl. This shape can increase the residence time of the flame and reduce the probability of the flame rushing out of the infrared cover 52, and an infrared heat effect is more ideal.

As shown in FIG. 1, in an embodiment of the present disclosure, two double-needle electrode rods 2 are connected to the ejection tube 12, one end of the two double-needle electrode rods 2 is close to the flame hole 111, and the two double-needle electrode rods 2 are located on opposite sides of the stove head 1.

In an embodiment, the burner bracket 212 is a strip structure, a quantity of the double-needle electrode rod is two, one end of the two double-needle electrode rods 2 is close to the flame hole 111 and is located on the opposite sides of the stove head 1 respectively, and is symmetrically provided at the periphery of the burner 11 in a 180-degree arrangement.

Further, the ejection tube 12 is detachably connected with a burner bracket 212, and the burner bracket 212 can rise or fall along the direction of the ejection tube 12. The ejection tube 12 is connected to the center of the burner bracket 212.

The burner bracket 212 extends to both sides of the burner 11 and is provided with an adjustment plate 122 that can adjust the angle, a double-needle electrode rod 2 is detachably connected to an adjustment plate 122.

In an embodiment, the quantity of double-needle electrode rods 2 may be greater than or equal to three, one end of the double-needle electrode rods 2 is located at the flame hole 111. A plurality of double-needle electrode rods 2 can be configured for ignition and detection of open flame simultaneously, or one of the double-needle electrode rods 2 can be configured for ignition, and the remaining double-needle electrode rods 2 can be configured for detection of open flame. A plurality of double-needle electrode rods 2 for detecting open flames are evenly provided around the burner 11.

In the embodiment, when the outside wind blows through the stove head 1, the wind direction affects the flame shape of the flame port, so that the flame is deviated from the original position and the double-needle electrode rod 2 cannot detect an open flame. Therefore, a plurality of double-needle electrode rods 2 are provided around the burner 11, so that no matter which direction the wind blows through the stove head 1, at least one double-needle electrode rod 2 is always in a downwind direction, which may continuously detect open flames, and thus prevents a situation that the double-needle electrode rod 2 is in the leeward direction and cause misjudgment of whether the flame is extinguished.

As shown in FIG. 1, in an embodiment of the present disclosure, each double-needle electrode rod 2 includes a high-voltage probe 21 and a low-voltage probe 22, the high-voltage probe 21 and the low-voltage probe 22 are provided at intervals, the low-voltage probe 22 is adjacent to the stove head 1, and the high-voltage probe 21 is away from the stove head 1.

In an embodiment, the structure of the high-voltage probe 21 is a "7" shape covered by an insulating material, exposing a head part of the metal probe, and the structure of the low-voltage probe 22 is a "1" shape. The high-voltage probe 21 and the low-voltage probe 22 are provided at intervals. It is understood that, the probe heads of the two probes generate an electric spark under the high voltage.

In the embodiment, the high-voltage probe 21 is connected to the high voltage, and the low-voltage probe 22 is grounded, by applying high voltage to the high-voltage probe 21, a voltage difference between the high-voltage probe 21 and the low-voltage probe 22 is caused, so that the electric sparks are generated between the high-voltage probe 21 and the low-voltage probes 22. At the same time, the system will apply an electrical signal to the high-voltage probe 21 at a certain frequency, and the electrical signal will flow through the plasmaized flame and air along the probe, and return to the plasma controller 3 through the low-voltage probe 22. It can be determined based on the electrical signal that whether an open flame exists.

As shown in FIG. 1, in an embodiment of the present disclosure, a resistance value of the electromagnetic valve 4 is 750 ohms.

In an embodiment, for a safety valve used in the flameout protection system 100, the generic gas electromagnetic valve 4 is replaced with a specific high-resistance (750 ohms) electromagnetic valve 4 to become a safety valve for the high-resistance electromagnetic valve 4.

In the embodiment, when the knob is pressed down manually, the electromagnetic valve 4 is pushed and opened, and the controller will supply the maintenance current of the electromagnetic valve 4 at the same time, when the flame is extinguished, the controller will cut off the maintenance current, and the electromagnetic valve 4 will close the gas channel. The power consumption of the electromagnetic valve 4 is very small during the working process, and the service life of the battery of the plasma flameout protection system 100 is extended to 6 months, which satisfies the user's need to replace the battery once a quarter.

Figure 3:
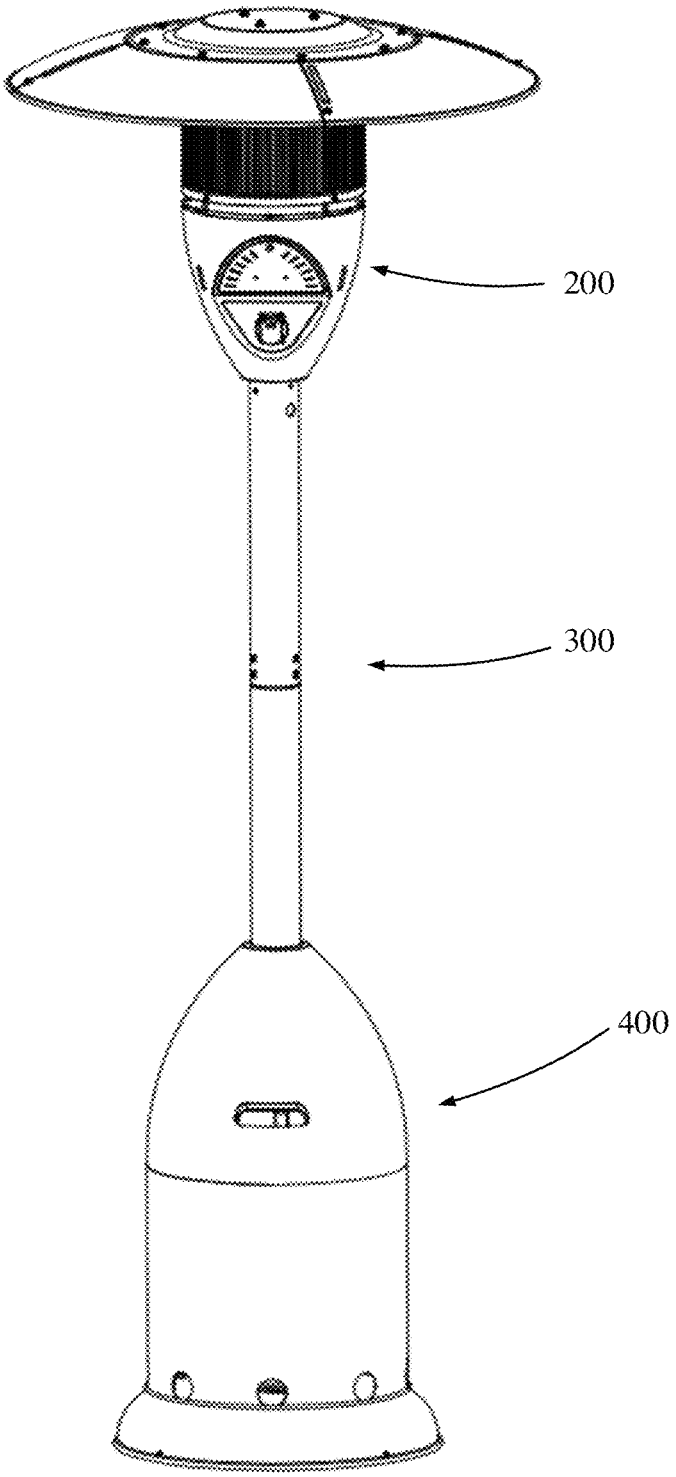
FIG. 3 is a schematic structural view of a heater according to an embodiment of the present disclosure.

As shown in FIG. 3, the present disclosure further provides a heater including: a flameout protection system 100 and a protective cover, a specific structure of the flameout protection system 100 refers to the above-mentioned embodiments, since the flameout protection system 100 adopts all the technical solutions of the above-mentioned embodiments, therefore at least have all the beneficial effects brought by the technical solutions of the above-mentioned embodiments, and will not be repeated here. The protective cover is provided with an installation cavity, and the flameout protection system 100 is provided in the installation cavity.

In an embodiment, the protective cover includes a stove head component 200, a base 400 and a column 300. The base 400 is provided on a ground for supporting the whole heater. The column 300 is vertically provided on the base 400, and the stove head component 200 is provided on the column 300. The stove head component 200 is provided with a flameout protection system 100, and the flameout protection system 100 includes a stove head 1 for burning liquefied gas to provide a heat radiation environment.

Further, the base 400 is provided with an air intake component 64, which is configured for connecting a liquefied gas source. The air intake component 64 includes a liquefied gas cylinder, a pressure reducing valve, a gas pipe, a safety valve and a valve nozzle. The liquefied gas cylinder is provided in the base 400, an outlet of the liquefied gas cylinder is connected to a pressure reducing valve, the pressure reducing valve is connected to the safety valve through a gas pipe, and the gas pipe is provided in the column 300. The valve plug of the safety valve can be controlled, and different holes on the valve plug are rotated to connect the stove head 1, thus to adjust the gas flow and close the safety valve, that is, to control the on-off of the stove head 1 and the size of the flame.

In an embodiment, the base 400 is provided with a counterweight to lower the center of gravity of the heater, reducing the probability that the heater is tilted and collapsed.

In an embodiment, the column 300 is detachably connected to the stove head component 200 and the base 400. The column 300 is divided into two an upper column 300 and a lower column 300, the two sections of column 300 facilitate an assembly and a disassembly of the heater. At the same time, a channel is provided in the column 300 for routing the pipelines of the air intake component 64.

In the embodiment, the heater is provided outdoors, and the base 400 is provided in a place with dense flow of people, such as beside a sidewalk. The air intake component 64 in the base 400 is connected to the liquefied gas source, and the liquefied gas enters the stove head 1 of the flameout protection system through the air intake component 64. When the heater is turned on, the electromagnetic valve 4 is opened through manual or electrical control, so that the liquefied gas passes through the stove head 1 and is mixed with the air, then is emitted from the flame hole 111, and then to be mixed with the air for the second time. The plasma controller 3 controls the double-needle electrode rod 2 to generate a high-voltage electric spark, the mixture of liquefied gas and air is ignited, and continuously burns to provide heat for the surrounding environment, so that pedestrians will not feel cold next to the heater. When the external wind is too strong or the flame of the stove head 1 is extinguished for other reasons, the plasma controller 3 cannot detect the open flame and then controls the electromagnetic valve 4 to close to prevent the leakage of liquefied gas from causing a potential risk. The electromagnetic valve 4 may also be closed actively to stop heater for providing heat.

Figure 4:
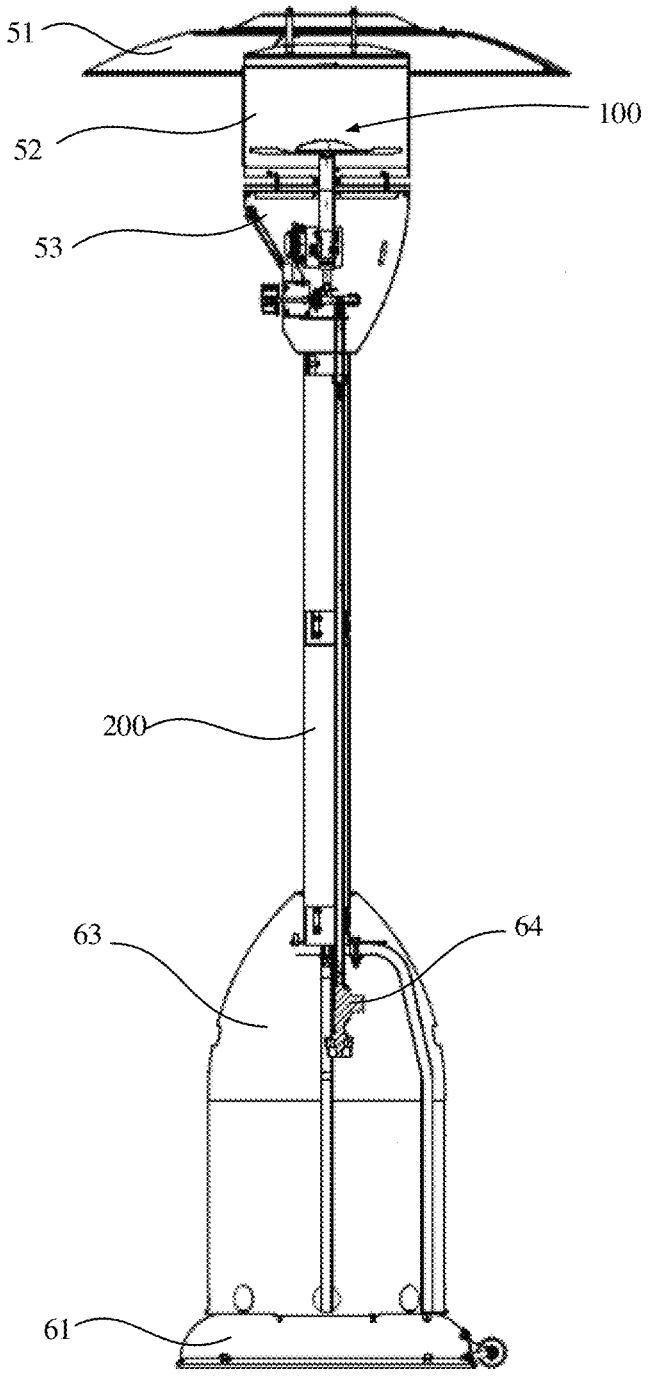
FIG. 4 is a schematic structural view of an inner part of the heater according to an embodiment of the present disclosure.

As shown in FIG. 4, in an embodiment of the present disclosure, the protective cover includes a casing 53, an infrared cover 52, and a reflection cover 51. The infrared cover 52 is connected to the casing 53. The reflection cover 51 is connected to the infrared cover 52, and the infrared cover 52 is provided with corrugated ribs. The casing 53, the infrared cover 52 and the reflection cover 51 form the installation cavity, and the flameout protection system 100 is provided in the installation cavity.

In an embodiment, the casing 53 is hemispherical, and the flameout protection system 100 is installed inside the casing 53. The stove cover includes an infrared cover 52 and a reflection cover 51. The infrared cover 52 is cylindrical, a plurality of small holes are provided on it, a cavity is provided inside, and one end of the infrared cover 52 is connected to the casing 53. The reflection cover 51 is umbrella-shaped, and the umbrella surface faces upwards, and is fastened downwards to another end of the infrared cover 52.

Further, a hole is provided at the bottom of the casing 53, and the column 300 is connected with the ejection tube 12 and passed through the hole. The burner 11 of the stove head 1 extends into the cavity of the infrared cover 52, and the heat of the flame ejected from the flame hole 111 of the burner 11 can be radiated to the surrounding environment through the infrared cover 52. The surface in the reflector 51 umbrella is a mirror surface or is provided with a coating that can reflect heat radiation, which can reflect the heat radiated from the flame.

In the embodiment, the stove head 1 and the flameout protection system 100 are installed in the casing 53, the column 300 supports the casing 53, and the air intake component 64 is connected to the stove head 1 through the column 300. The stove head 1 is located in the cavity of the infrared cover 52, the infrared cover 52 is provided with pores, and due to the thin infrared cover 52 and the pores of the infrared cover 52, the heat radiated from the flame of the stove head 1 can pass through the infrared cover 52 and is transmitted to the external environment. The mirror surface or reflective coating of the reflection cover 51 can change the direction of heat radiation, reduce heat radiation from being transferred to an environment without a demand for increasing the temperature, and improve the infrared heat effect of the heater.

Figure 6:
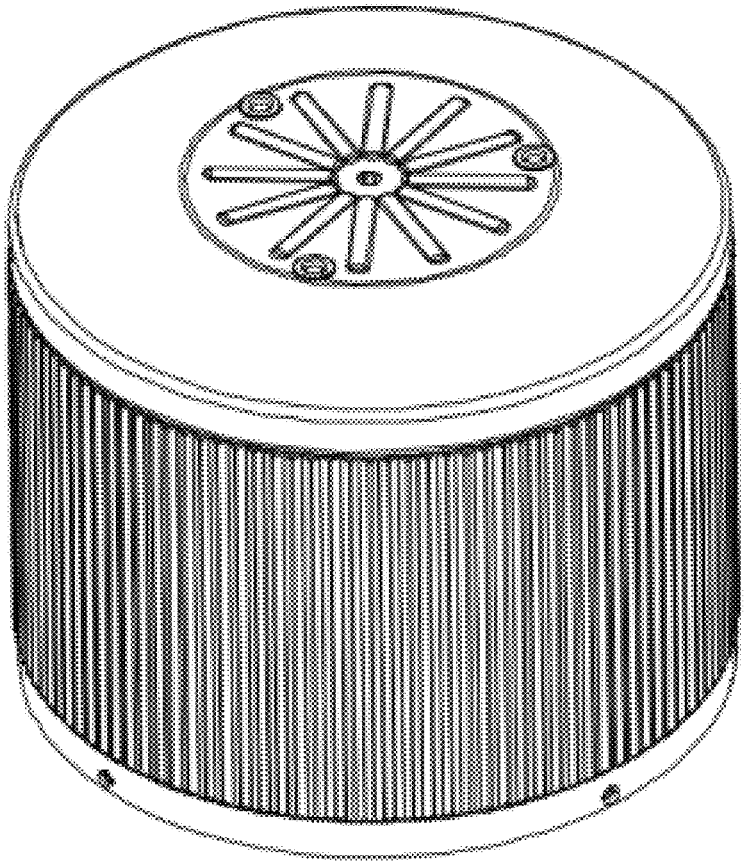
FIG. 6 is a schematic structural view of an infrared cover of the heater according to an embodiment of the present disclosure.

As shown in FIG. 6, in an embodiment of the present disclosure, the infrared cover 52 is provided with corrugated ribs.

In an embodiment, the infrared cover 52 is designed with vertical ribs, and a plurality of ribs are evenly provided on the infrared cover 52. It can be understood that the vertical ribs can improve the radial collapse resistance of the infrared cover 52.

Further, by pressing the entire infrared cover 52 into a vertical corrugated plate, then enclosing the corrugated plate to tube to form the infrared cover 52, and the corrugated plate has the function of ribs at this time.

In the embodiment, under the condition of the same thickness and material, the collapse resistance is greatly increased when compared to the infrared cover 52 with a flat plate structure, so that when the flame ejected from the flame hole 111 of the stove head 1 heats the infrared cover 52, the structure of the corrugated ribs makes the infrared cover 52 not easy to be collapsed under high temperature.

Figure 5:
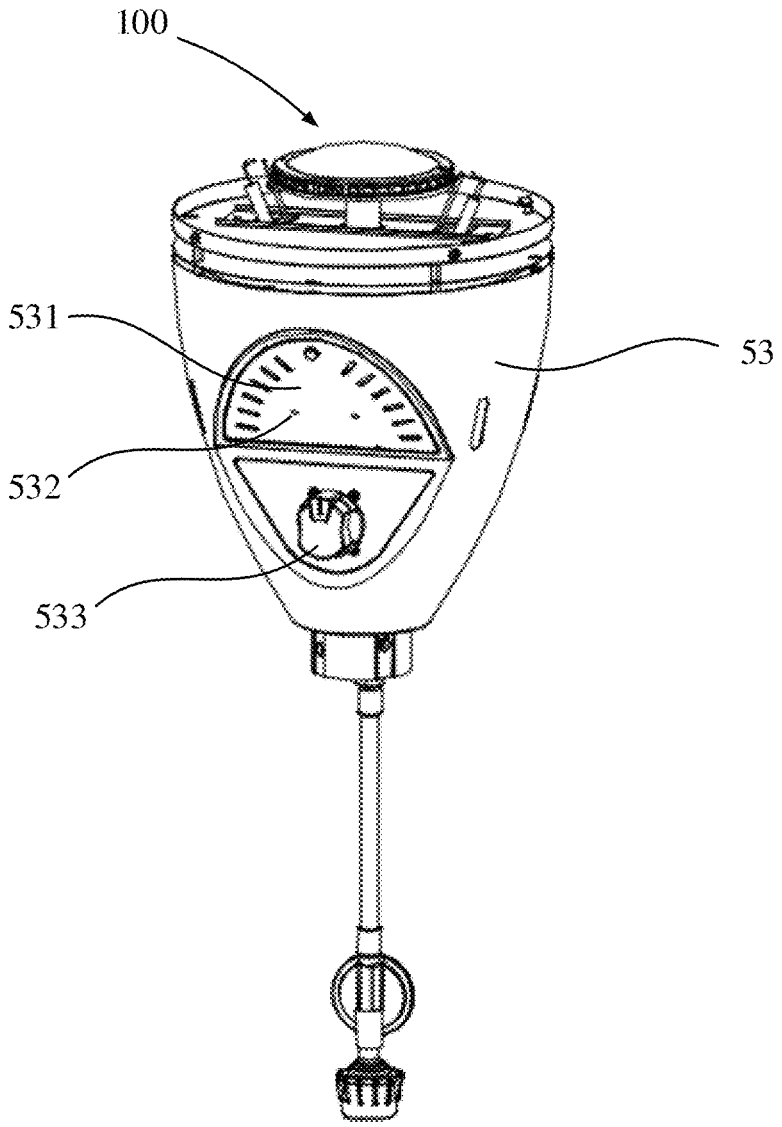
FIG. 5 is a schematic structural view of a head component of the heater according to an embodiment of the present disclosure.

As shown in FIG. 5, in an embodiment of the present disclosure, the casing 53 is provided with a maintenance door 531 and a knob 533, the installation cavity is opened or closed by the maintenance door, and the knob 533 is configured for controlling the electromagnetic valve 4.

In an embodiment, the casing 53 is provided with the maintenance door 531, one end of the maintenance door 531 is connected to the casing 53 through a hinge, and another end of the maintenance door 531 is connected to the casing 53 through a lock or buckle. The user can open the maintenance door 531 to expose the stove head 1 and the flameout protection system 100 inside the casing 53. The size of the maintenance door 531 is designed to allow users to maintain and replace the flameout protection system 100.

In an embodiment, the knob 533 can control the valve plug of the electromagnetic valve 4, and the valve plug is provided with holes of different sizes. The gas flow can be adjusted on and off by the knob 533, that is, the switch of the stove head 1 and the size of the flame can be controlled.

In the embodiment, the installation cavity of the casing 53 can be opened through the maintenance door 531, and the plasma controller 3, the electromagnetic valve 4, the double-needle electrode rod 2 and the wires for electrical connection can be checked, replaced or manually operated.

As shown in FIG. 5, in an embodiment of the present disclosure. The stove head component 200 further includes a decorative light 532. The decorative light 532 is provided on the casing 53 or the knob 533. The decorative light 532 is electrically connected to the flameout protection system 100.

In an embodiment, the decorative light 532 is connected to the casing 53 or the knob 533, and the decorative light 532 can illuminate the knob 533 of the casing 53, which enables the user to see the knob 533 clearly and operate the heater at night.

Further, the decorative light 532 is electrically connected to the plasma controller 3, the color, brightness or on-off rule of the decorative light 532 can be linked with the battery power of the plasma controller 3. The power of the plasma controller 3 can be determined through the decorative light 532.

In the embodiment, when the power of the plasma controller 3 is sufficient, the decorative light 532 is set to be always on, and when the power of the plasma controller 3 is insufficient, the decorative light 532 is set to flash, when the plasma controller 3 is out of power, the decorative light 532 is set to be always off. The user can intuitively and conveniently observe the on-off status of the decorative light 532 and directly determine the power of the plasma controller 3. Thereby the maintenance door 531 is opened to replace or charge the plasma controller 3.

Figure 7:
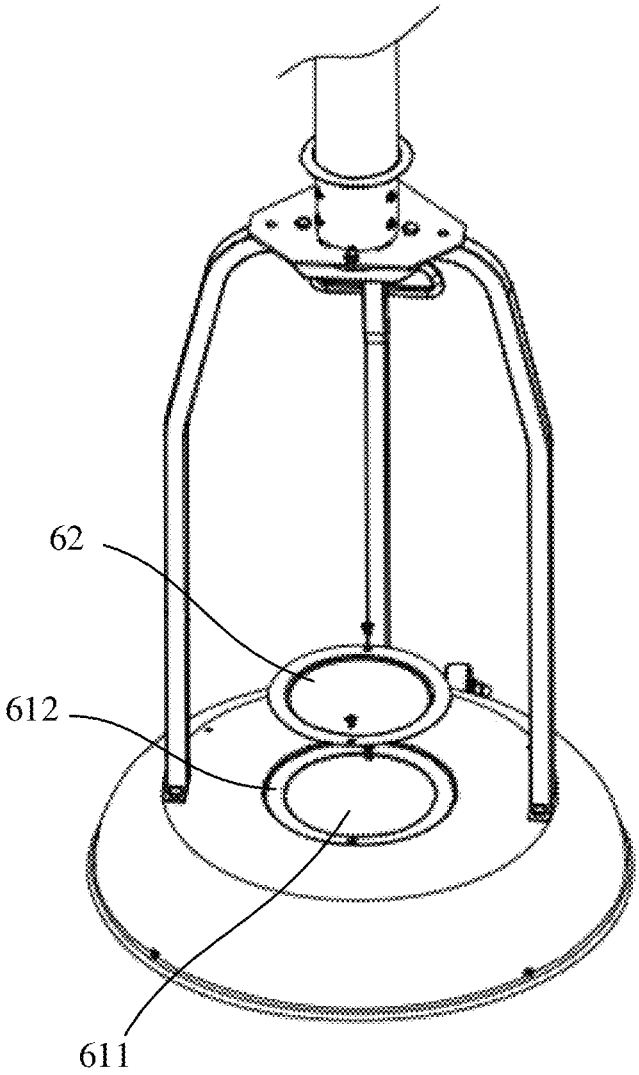
FIG. 7 is schematic structural view of a base of the heater according to an embodiment of the present disclosure.

As shown in FIG. 7, in an embodiment of the present disclosure, the heater further includes a base 400 and a sand cover 62, the base 400 is connected to the protective cover; the base 400 is provided with a counterweight cavity 611 and a sand filling hole 612, and the sand filling hole 612 is communicated with the counterweight cavity 611, and the sand cover 62 is detachably connected to the sand filling hole 612. The heater further includes a high-pressure relief valve, one end of the high-pressure relief valve is connected to the flameout protection system 100, and another end of the high-pressure relief valve is connected to the liquefied gas source.

In an embodiment, the structure of the counterweight base 61 is disc-shaped, and a counterweight cavity 611 is provided inside. The surface of the counterweight base 61 is provided with a sand filling hole 612, through which the user can fill the counterweight base 61 with fluids such as sand or water to increase the weight of the counterweight base 61. The sand filling hole 612 is provided with threads, and the sand cover 62 can be detachably connected to the sand filling hole 612 through the threads to block the counterweight cavity 611. The cylinder 63 is in a hemispherical structure, one end is buckled on the counterweight base 61 to form a cavity, and another end is connected to the column 300. The air intake component 64 is provided in the cylinder 63, and the cylinder 63 is provided with an air intake, and the air intake is communicated with the air intake component 64.

Furthermore, the high-pressure relief valve is connected to the liquefied gas cylinder, and other regulators, safety valves, burners 11, etc. are all made of components suitable for high-pressure. It is more conducive to increasing the calorific value, injecting more air, improving outdoor wind resistance, and completely burning.

In the embodiment, when the heater is transported, the base 400 without counterweight makes the overall weight of the heater lighter, which is convenient for transport. When the heater is transported to a designated location, the sand cover 62 in the base 400 is opened, the gravel is poured into the counterweight cavity 611, and then the sand cover 62 is closed. The counterweight cavity 611 filled with gravel can play a role of counterweight, so that the heater is not easy to be dumped, and the acquisition of gravel is also very convenient and simple. When the heater is to be removed, the gravel in the counterweight cavity 611 is poured out, which reduces the weight of the heater and is easy to transport.

The above are only some embodiments of the present disclosure, and do not limit the scope of the present disclosure thereto. Under the inventive concept of the present disclosure, equivalent structural transformations made according to the description and drawings of the present disclosure, or direct/indirect application in other related technical fields are included in the scope of the present disclosure.

What is claimed is:

1. A flameout protection system, comprising:

a stove head provided with a flame hole and an air intake communicated with the flame hole;

a double-needle electrode rod connected to the stove head;

an electromagnetic valve provided at the air intake and configured for controlling an on-off of the air intake; and a plasma controller electrically connected to the double-needle electrode rod and the electromagnetic valve, wherein one end of the double-needle electrode rod is close to the flame hole, and the plasma controller is configured for controlling the electromagnetic valve to open or close the air intake;

wherein the stove head comprises:

a burner provided with the flame hole;

an ejection tube connected to the burner; and a burner bracket connected to the ejection tube, wherein the ejection tube is provided with the air intake, and the electromagnetic valve is connected to the ejection tube, and the double-needle electrode rod is connected to the burner bracket;

wherein a periphery of the burner is provided with a plurality of flame holes, and the plurality of flame holes are evenly spaced apart along the periphery of the burner; and wherein the flameout protection system further comprises two double-needle electrode rods, and the two double-needle electrode rods are located at opposite sides of the stove head.

2. The flameout protection system of claim 1, wherein each of the two double-needle electrode rods comprises a high-voltage probe and a low-voltage probe, the high-voltage probe and the low-voltage probe are provided at intervals, the low-voltage probe is adjacent to the stove head, and the high-voltage probe is away from the stove head.

3. The flameout protection system of claim 1, wherein a resistance value of the electromagnetic valve is 750 ohms.

4. A heater, comprising:

a protective cover provided with an installation cavity; and the flameout protection system according to claim 1, wherein the flameout protection system is provided in the installation cavity;

wherein the protective cover comprises:

a casing;

an infrared cover connected to the casing; and a reflection cover connected to the infrared cover, the infrared cover being provided with corrugated ribs, wherein the casing, the infrared cover and the reflection cover form the installation cavity, and the flameout protection system is provided in the installation cavity.

5. The heater of claim 4, wherein the casing is provided with a maintenance door and a knob, the installation cavity is opened or closed by the maintenance door, and the knob is configured for controlling the electromagnetic valve.

6. The heater of claim 4, further comprising:

a decorative light provided on the casing or the knob, the decorative light being electrically connected to the flameout protection system.

7. The heater of claim 4, further comprising:

a base connected to the protective cover; and a sand cover, wherein the base is provided with a counterweight cavity and a sand filling hole, the sand filling hole is communicated with the counterweight cavity, and the sand cover is detachably connected to the sand filling hole.

8. The heater of claim 4, further comprising:

a high-pressure relief valve, wherein one end of the high-pressure relief valve is connected to the flameout protection system, and another end of the high-pressure relief valve is connected to a liquefied gas source.

* * * * *